United States Patent [19]

Paynton et al.

[11] 4,325,291

[45] Apr. 20, 1982

[54] CHIMNEY CAP AND SECUREMENT

[75] Inventors: Richard H. Paynton; William C. Paynton, both of Attleboro Falls, Mass.

[73] Assignee: Improved Consumers Products, Inc., Attleboro Falls, Mass.

[21] Appl. No.: 122,777

[22] Filed: Feb. 19, 1980

[51] Int. Cl.[3] ..... F23L 17/12

[52] U.S. Cl. ..... 98/67; 98/66 A; 98/83

[58] Field of Search ..... 98/66 R, 66 A, 67, 76, 98/82, 83

[56] References Cited

U.S. PATENT DOCUMENTS

| | | | |
|---|---|---|---|
| 2,632,376 | 3/1953 | Driscoll | 98/67 |
| 2,660,106 | 11/1953 | Gray | 98/83 |
| 2,755,730 | 7/1956 | Douty | 98/67 |
| 2,805,616 | 9/1957 | Roth | 98/67 |
| 3,101,039 | 8/1963 | Duchene et al. | 98/67 X |
| 3,826,181 | 7/1974 | Schrade | 98/66 R |

FOREIGN PATENT DOCUMENTS

| | | | |
|---|---|---|---|
| 823857 | 9/1969 | Canada | 98/66 A |
| 6547 | of 1894 | United Kingdom | 98/66 A |
| 1283 | of 1903 | United Kingdom | 98/66 R |
| 579027 | 7/1946 | United Kingdom | 98/66 R |

*Primary Examiner*—Lloyd L. King
*Assistant Examiner*—Harold Joyce
*Attorney, Agent, or Firm*—Leitner, Palan, Martin & Bernstein

[57] ABSTRACT

A chimney cap having a securement extending from the crown support to engage the interior of the chimney and secure the cap thereto.

7 Claims, 5 Drawing Figures

CHIMNEY CAP AND SECUREMENT

BACKGROUND OF THE INVENTION

The present invention relates generally to chimney caps and more specifically to an improved chimney cap having a securement means.

Chimney caps have come in many shapes and forms. They may be basically broken down into two main categories, namely those which form a cover over and are spaced from the top of the chimney to prevent rain and other debris from falling down the chimney and those which totally enclose the top of the chimney and by appropriate construction form a vacuum when a wind traverses the edge of the cap. For both types of chimney caps, the means of securing the cap to the chimney generally includes some sort of device or fastner which mounts the cap to the exterior of the chimney. Thus, the cap must be specifically designed for each chimney cross-section to which it must be mounted.

To make the chimney caps more adaptable to a multitude of chimney cross-sections, shapes and dimensions, adapter kits have been provided. As with the chimney caps themselves, the adapter kits include a conversion element secured to the exterior of the chimney with the cap fastened to the conversion element. As with the chimney caps the conversion devices had to be adapted or designed specifically for the shape and cross-section and area of the specific chimneys.

Thus, there exists a need for a chimney cap and securement which will allow the cap to be secured to a chimney of any cross-sectional shape or area.

SUMMARY OF THE INVENTION

An object of the present invention is to provide a complete chimney cap with securement means.

Another object of the present invention is to provide chimney cap and securement means which allows the adapting of the cap to a plurality of chimney shapes and areas.

Still another object of the present invention is to provide a chimney cap and securement which is durable and long lasting.

An even further object of the invention is to provide a chimney cap and securement which allows a round vacuum cap to be mounted and secured to a square chimney.

Still an even further object of the present invention is to provide a chimney cap and securement which allows a gable shaped chimney cap to be secured to a chimney.

These and other objects of the invention are attained by a chimney cap having a securement which adjustably extends from the interior of the cap support through to the exterior to engage the interior of the chimney and secure the chimney cap thereto. For vacuum type caps, the spherical shaped crown is secured to an annulus shaped support. For cover style caps, a gable shaped crown is connected to a pair of legs which constitute the support. For both types of caps, the securement may be a threaded shaft extending radially from one end of the support to engage the interior of the chimney and a sleeve over the other end of the thread shaft and extending radially from the support to engage the chimney 180° from the point where the first end of the threaded shaft engaged the interior of the chimney. The sleeve may be interiorly threaded or a threaded collar adjustably extends the sleeve relative to the support means and locks it into the extended position. Alternatively the securement may be a plurality of threaded elements adjustably extending through the exterior of the support to engage the interior of the chimney. A plate is provided encompasing the exterior of the annular support and is positioned between the extended securement and an exterior circumferential rim of the support to cover the portion of the chimney non-occupied by the support.

These and other objects, advantages and novel features of the present invention will become apparent from the following detailed description of the invention when considered in conjunction with the accompanying drawings.

DESCRIPTION OF THE PREFERRED EMBODIMENTS

Figure 1:
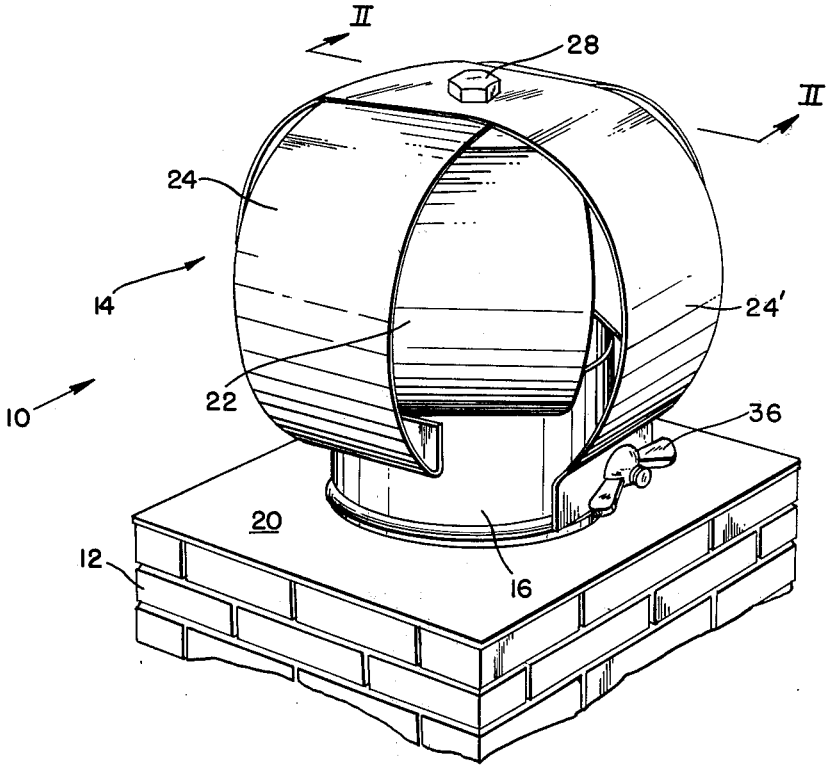
FIG. 1 is a perspective view of a spherical chimney cap incorporating the principles of the present invention installed to a chimney.
Figure 2:
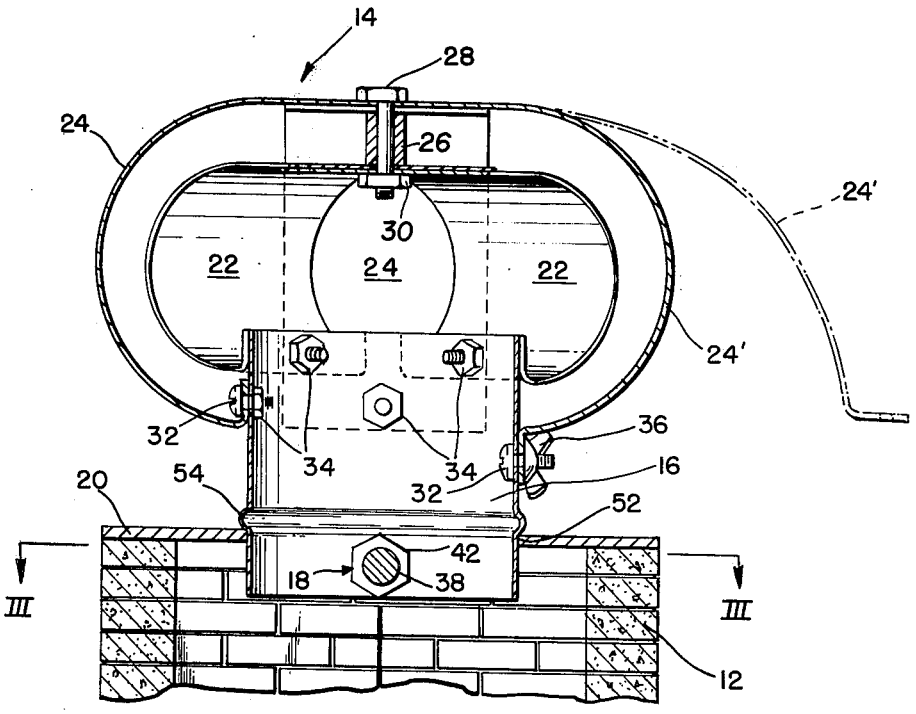
FIG. 2 is a cross-sectional view taken along lines II—II of FIG. 1.
Figure 3:
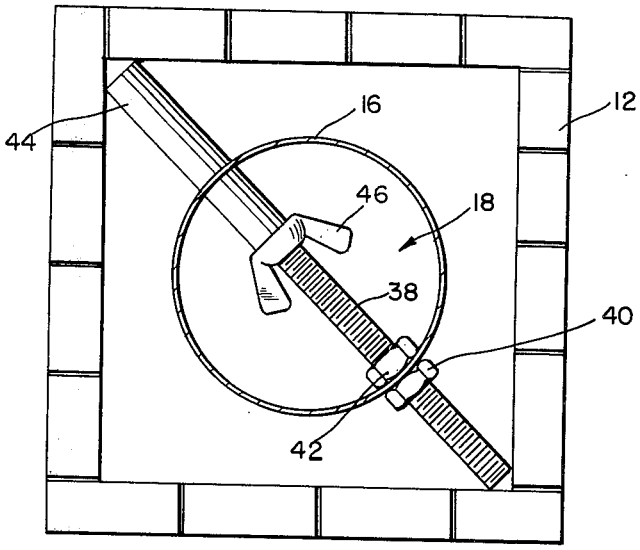
FIG. 3 is a top cross-sectional view taken along lines III—III of FIG. 2.

As illustrated in FIGS. 1, 2, and 3, a chimney cap 10 is shown mounted to a chimney 12 and includes a crown portion 14, a support 16, securement 18 and a plate 20. For the specific type of cap illustrated in FIGS. 1 and 2, the crown 14 is generally spherical shaped and includes an inner crown 22 and outer crown 14. Inner Crown 22 is made up of two slats secured to the annular support 16 at their respective ends and crossing at the center at 90° relative to each other. The outer crown 24 is similar to the inner crown 22 and includes two slats secured to the support 16 at opposite ends and intersecting with each other at the center at a 90° relationship. The outer crown 24 encompasses the inner crown 22 having its slats aligned with the opening between the slats 22 of the inner crown. Thus, the slats of the outer crown 24 are positioned 45° relative to the slats of the inner crown 22. This results in one of the many configurations of a vacuum styled cap for a chimney.

The top of crowns 22 and 24 are separated from each other by a spacer 26 and are secured together by a fastner 28 which may be a bolt having a nut 30. Also illustrated in FIG. 2, the slats of the inner crown 22 and the outer crown 24 are secured to the support 16 by fastners which are illustrated as nuts and bolts 32 and 34, respectively. One of the slats 24' of the outer crown 24 is secured to the support 16 by a wing nut 36. This allows quick removal of the fastner such that the slat 24' may be raised to the position as illustrated in phantom in FIG. 2. This allows access to the interior of the support 16 to permit adjustment of the securement 18 to be explained hereafter. Since the slats 24 are made of sheet metal, they are very flexible and consequently, no special configuration, for example a hinge, need be used.

The securement 18, as illustrated in FIG. 3, includes a threaded shaft 38 adjustably secured to the support 16 by a pair of nuts 40 and 42. The pair of nuts 40 and 42 form a lock nut configuration. Positioned on the other end of thread shaft 38 is a sleeve 44. This sleeve may be interiorly threaded and received on the externally threaded shaft 38. This will allow adjustment of the extension of the sleeve 44 relative to the stationary shaft 38 by rotation of the sleeve 44. Alternatively, the sleeve 44 may have a smooth interior and an interior diameter greater than the exterior diameter of the threaded shaft 38. For the non-threaded sleeve 44, wing nut 46 is provided on the threaded shaft 38. The wing nut will adjustably position the extension of sleeve 44 relative to the stationary shaft 38 and lock it in the extended adjusted position. It should be noted that wing nut 46 may be welded or joined by other means to sleeve 44.

To determine the extended position of threaded shaft 38, the diagonal of the chimney 12 is measured. The diameter of the support 16 is subtracted from the diagonal measurement and the difference is divided in half. This resulting measurement is the measurement of the extension of the threaded shaft 38 radially outward from the support 16. The lock nuts 40 and 42 are loosened and the thread shaft 38 is positioned to have this extended measurement. Lock nuts 40 and 42 are then tightened to securely fix the shaft 38 to the support 16. Once the support 16 is positioned interior to the chimney 12, a hand is extended down through the opening through the extended slat 24' and the sleeve is extended by rotating it, if it is internally threaded, or by rotating the wing nut 46 until the forward most edge of the sleeve 46 engages the interior of the chimney 180° from the point at which the extended portion of the thread shaft 38 engages the interior of the chimney. This way the securement 18 engages and secures the chimney cap 10 to the interior of the chimney.

It should be noted that in FIG. 3, securement 18 engages the chimney at its diagonal. This is preferred since it provides a non-rotational engagement of the securement 18 to the chimney. Alternatively, but not preferred, the securement 18 may engage any two opposed parallel faces of the chimney to secure the cap 10 to the interior of the chimney.

Figure 4:
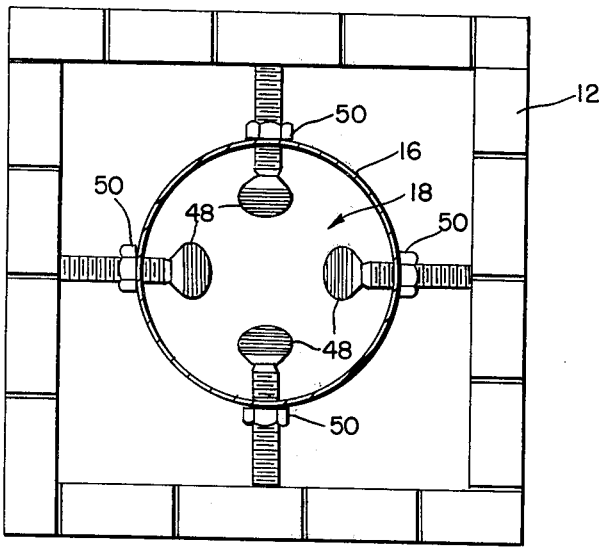
FIG. 4 is a cross-sectional view of another embodiment of the securement means according to the principles of the present invention.

Another securement 18 which may be provided for the support 16 is illustrated in FIG. 4 as a plurality of thumb screws 48 extending from the interior radially through to the exterior support 16. Each of the thumb screws 48 includes a nut 50 welded to the support 16. The thumb screws 48 are positioned in pairs 180° apart. Although illustrated in two pairs, it is obvious that other numbers of thumb screws and angular configurations may be provided. The essence being that the securement 18 be adjustable from the interior of the support 16 and extended exteriorly to engage the interior of the chimney 12 to secure the cap thereto. It should also be noted that instead of a pair of lock nuts 40 and 42 in FIG. 3, one of the nuts may be provided and welded to the support 16.

The last element of the chimney cap 10 is the plate 20 which includes a circular opening 52 in the center thereof to receive the circular support 16. A rim or bead 54 on the exterior of the support 16 is used to retain the plate 20 in place. The plate 20 is positioned between the bead 54 and the securement 18. The chimney cap 10 is installed by positioning the total assembly over the top of the opening of chimney 12. The support 16 is lowered into the interior of the chimney until the plate 20 comes to rest on the top edge of the chimney 12 and the bead 54 of the support 16 comes to rest on the top of the plate 20. Thus, the plate supports the weight of the cap 10 in addition to the securement 18. Slat 24' is raised and the installer puts his hand through the cap 12 down into the support 16 to adjustably extend the sleeve 44. Once the securement 18 has engaged and secured the support 16 to the chimney, it also clamps the plate 20 down on top of the top of the chimney 12. The plate 20 may be cut to match the exterior dimensions of chimney 12 or may be used as is. The purpose of the place 20 is to cover the remainder of the chimney opening 12 which is not occupied by the support 16. To provide a more perfect seal of the plate 20 to the chimney 12, adhesive, for example a silicon based adhesive may be used along rim of the chimney 12.

Figure 5:
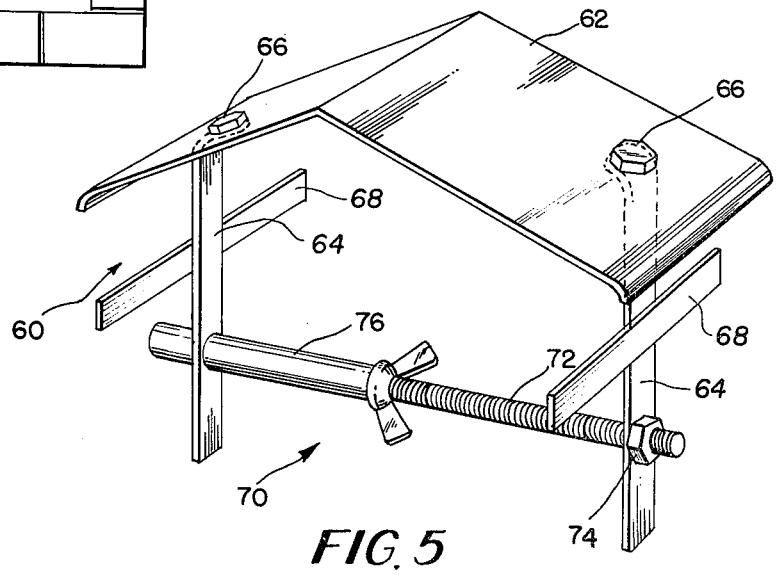
FIG. 5 is a perspective view of a gable shaped chimney cap incorporating the principles of the present invention.

Another type of chimney cap which may be used is illustrated in FIG. 5 as 60. This chimney cap has a gable styled crown 62 and a pair of support legs 64 fastened thereto by fastener 66. Each of the support legs 64 includes a horizontal arm 68 extending on both sides thereto. The horizontal arm 68 will engage the top of the chimney and determine the height of the gable 62 relative to the top of the chimney and support the weight of the cap 60. Extending through openings in each of the legs 64 is the securement 70. The securement 70 includes threaded element 72 received in a bolt 74 welded to one of the legs 64. On the other end of the threaded element 70 is a threaded sleeve 76. As with the chimney cap 10, the chimney cap 60 is positioned with the support legs 64 extending down into the interior of the chimney. The securement 70 is radially extended with thread shaft 72 extending at a fixed distance and sleeve 76 being adjustably extended until the two ends of the securement 70 engage the interior of the chimney 180° apart. This secures the chimney cap 60 to the interior of the chimney. The crown 62 may be other than gable. Also, the horizontal arms 68 instead of being permanently fixed by welding for example, may be adjustable using removable fastners. Alternatively, a pair of securements 70 may be used extended paralles to the horizontal arms 68.

Preferrably, the chimney 10 and 60 are formed from stainless steel. To reduce the overall cost of manufacture, the non-threaded sleeve 44 and non-threading of the sleeve 76 is preferred since these are more readily available parts. Similarly, the fastners 66 as well as the nuts and bolts 28, 30, 32 and 34 are made of stainless steel. Other materials may be used although they will not produce the extended life of stainless steel.

It is evident from the description of the preferred embodiments that the objects of the invention are attained in that a chimney cap and securement is provided which will allow the insulation of a standard chimney cap to a plurality of chimneys of varying cross-sections and dimensions. Although the invention has been illustrated and described in detail, it is to be clearly understood that the same is by way of illustration and example only and is not to be taken by way of limitation. Although the present invention is designed primarily for a rectangular chimney, it may also be used with a circular chimney. If plate 20 is not needed, the bead 54 will engage the circular chimney and support the cap. The spirit and scope of this invention is to be limited only by the terms of the appended claims.

What is claimed is:

1. A cap capable of being secured to a chimney or flue of any configuration or size comprising:

an annular member for insertion into a chimney or flue, said annular member having an outside circumference smaller than an opening of said chimney or flue;

a first plurality of slats separated by spaces along at least a portion of their length in a circumferential direction and connected to said annular member to form a first crown;

a second plurality of slats connected to said annular member to form a second crown exterior said first crown with the slats of said second crown being aligned with the spaces between the slats of said first crown;

one of said slats of said second crown being detachable at its connection to said annular member to allow access to the interior of said annular member;

an exterior circumferential rim below said connection of said slats on said annular member for engaging a plate covering the top of a chimney and through which said annular member is to be inserted to thereby support said cap on said plate; and securement means extending from the interior through to the exterior of said annular member for securing said cap and said plate to said chimney or flue by engaging the interior of said chimney or flue when adjustably extended.

2. The cap according to claim 1 wherein said securement means includes a threaded shaft extending from the interior through to the exterior of said annular member, whereby said exterior end of said shaft engages said chimney or flue, and a sleeve member adjustably received on the other end of said shaft extending exterior said annular means to engage said chimney flue 180° relative to the engagement by said shaft.

3. The cap according to claim 2 wherein said sleeve is interiorly threaded and is threadably adjusted on said shaft.

4. The cap according to claim 2 or 3 wherein said securement means includes a collar threadably received on said shaft for extending said sleeve and locking said sleeve in a selected extended position.

5. The cap according to claim 1 wherein said securement means includes a plurality of individual threaded elements adjustably extending from the interior through to the exterior of said annular member to engage and secure said cap to the interior of said chimney or flue.

6. The cap according to claim 1 wherein said cap is formed from stainless steel.

7. A cap capable of being secured to a chimney or flue of any configuration or size comprising:

an annular member for insertion into a chimney or flue, said annular member having an outside circumference smaller than an opening of said chimney or flue;

a first plurality of slats separated by spaces along at least a portion of their length in a circumferential direction and connected to said annular member to form a first crown;

a second plurality of slats connected to said annular member to form a second crown exterior said first crown with the slats of said second crown being aligned with the spaces between the slats of said first crown;

one of said slats of said second crown being detachable at its connection to said annular member to allow access to the interior of said annular member;

a plate encompassing said annular member radially for covering the portion of a chimney or flue not occupied by said annular member;

an exterior circumferential rim below said connection of said slats on said annular member for engaging said plate and to thereby support said cap on said plate; and securement means extending from the interior through to the exterior of said annular member for securing said cap and said plate to said chimney or flue by engaging the interior of said chimney or flue when adjustably extended.

* * * * *